US007455579B2

(12) United States Patent
Takeuchi

(10) Patent No.: US 7,455,579 B2
(45) Date of Patent: Nov. 25, 2008

(54) OVERFLOW CHUTE APPARATUS FOR COIN STORING

(75) Inventor: Toru Takeuchi, Saitama (JP)

(73) Assignee: Asahi Seiko Company Ltd., Saitama-ken (JP)

( * ) Notice: Subject to any disclaimer, the term of this patent is extended or adjusted under 35 U.S.C. 154(b) by 13 days.

(21) Appl. No.: 11/690,252

(22) Filed: Mar. 23, 2007

(65) Prior Publication Data

US 2007/0232214 A1 Oct. 4, 2007

(30) Foreign Application Priority Data

Mar. 31, 2006 (JP) ..... 2006-096531

(51) Int. Cl.
*G07D 1/00* (2006.01)

(52) U.S. Cl. ..... 453/18

(58) Field of Classification Search ..... 453/18; 193/DIG. 1; 232/55

See application file for complete search history.

(56) References Cited

FOREIGN PATENT DOCUMENTS

JP 2003-102903 4/2003

*Primary Examiner*—Patrick Mackey
*Assistant Examiner*—Mark Beauchaine
(74) *Attorney, Agent, or Firm*—McGlew & Tuttle, P.C.

(57) ABSTRACT

A coin storing apparatus with overflow chute apparatus is supplied with coins from a slot-shaped replenishing port to a coin storing portion and stores the coins in piles in the coin storing portion. The coins overflow via a downward overflow chute having a width equal to or larger than a diameter of a coin, when an amount of the coins in the coin storing portion reaches a predetermined amount. A downward slope wider than the diameter of the coin is disposed below the replenishing port. A guide rail is continuous with the downward slope and has a predetermined width narrower than a radius of the coin. A downward overflow chute extends at a predetermined angle to the guide rail and has a width equal to or larger than the diameter of the coin and is provided below the guide rail. The guide rail is disposed on the downward slope adjacent to a downstream side of the overflow chute. A coin dropped from the replenishing port comes in face contact with the downward slope, and then a lower face of the coin on a downstream side of the overflow chute slides on the guide rail to reach the storing portion, and the coins accumulated in the storing portion can be moved to the overflow chute.

7 Claims, 6 Drawing Sheets

OVERFLOW CHUTE APPARATUS FOR COIN STORING

CROSS REFERENCE TO RELATED APPLICATIONS

This application claims the benefit of priority under 35 U.S.C. § 119 of Japan Patent Application JP 2006-096531 filed Mar. 31, 2006, the entire contents of which are incorporated herein by reference.

FIELD OF THE INVENTION

The present invention relates to an overflow chute apparatus wherein coins are stored in a coin storing portion when an amount of the coins reaches a predetermined amount or less in a coin storing apparatus which is supplied with coins from a slot-shaped replenishing port and stores the coins in piles, and the coins are caused to overflow automatically when a storing amount of the coins exceeds the predetermined amount. The term "coin" used in this text embraces a coin which is currency, a medal or token for a game machine, a token as money or things of a like kind.

BACKGROUND OF THE INVENTION

A circulation type coin dispensing apparatus which receives coins to store them in a coin storing portion and dispenses the received coins in the coin storing portion has the function of allowing newly received coins to overflow when a coin stored amount in the coin storing portion exceeds a predetermined amount. This keeps a stored amount in the coin storing portion at a proper stored amount. In this case, it is known in the art to cause coins to slide down naturally on an overflow chute when a piling amount exceeds a predetermined amount by replenishing coins from a slot-shaped replenishing port to accumulate the coins in piles.

For example, in JP-A-2003-102903 (FIG. 2, Page. 4) a pachinko-slot machine is disclosed in which coins deposited from a slot are discriminated about their authenticity by a coin selector, and true coins are dropped into a storing bowl, and stored in piles. The storing bowl is part of a coin storing portion of a coin hopper with a slot-shaped replenishing port. When an amount of the coins accumulated in piles exceeds a predetermined amount, the coins are dropped to an overflow chute beyond a wall, and then the coins slide on the overflow chute and are stored in a safe. Since the coins stored are accumulated in piles in the coin storing portion, there is a problem that the coins are accumulated without being caused to overflow when the coins sliding down to the overflow chute are jammed.

Another technique detects a stored amount in a coin storing portion. When it is detected that the stored amount reaches a predetermined amount, coins received are distributed to an overflow chute and stored in a safe without being stored in the coin storing portion. For example, a full sensor composed of a pair of electrodes is disposed in the coin storing portion. A storing portion and a distributing apparatus to the overflow chute are disposed on a downstream side of a coin receiving portion. Since coins are distributed to the coin storing portion and the overflow chute before the coins are stored in the coin storing portion, the coins are not accumulated so as to exceed the stored amount. However, since the full sensor and the distributing apparatus must be provided, such a coin dispensing apparatus becomes expensive.

SUMMARY OF THE INVENTION

A first object of the present invention is to provide an overflow chute apparatus for a coin storing portion where an amount of coins accumulated in a coin storing portion does not exceed a predetermined amount.

A second object of the present invention is to inexpensively provide the overflow chute apparatus for a coin storing portion where an amount of coins accumulated in a coin storing portion does not exceed a predetermined amount.

According to the invention, an overflow chute apparatus for a coin storing portion of the present invention is provided. The overflow chute apparatus is for the coin storing apparatus which is supplied with coins from a slot-shaped replenishing port to a coin storing portion and stores the coins in piles in the coin storing portion and causes the coins to overflow via a downward overflow chute having a width equal to or larger than a diameter of a coin, when an amount of the coins in the coin storing portion reaches a predetermined amount. A downward slope wider than the diameter of a coin is disposed below the replenishing port. A guide rail having a predetermined length which is continuous with the downward slope and extends to an elongate a part of the downward slope, is provided on a downstream side of the overflow chute beyond a center of gravity of a coin sliding down on the downward slope. The downward overflow chute is disposed below the guide rail such that the downward overflow chute intersects at a predetermined angle to the guide rail. After a coin dropped from the replenishing port comes in face contact with the downward slope, a lower face of the coin on a downstream side of the overflow chute beyond the center of gravity of the coin is guided by the guide rail to reach the coin storing portion. Coins accumulated in the coin storing portion can be moved to the overflow chute.

The guide rail may be set at a position of about one third of the diameter of the coin for a coin dropped from the replenishing port for coins. That is the guide rail may extend laterally into a path of a coin dropped from the replenishing port by about one third of the diameter of the coin.

A lower end of the guide rail may advantageously be disposed away from an upper face of the overflow chute by about two thirds of the diameter of the coin.

According to this configuration, a coin is dropped onto the downward slope area from the slot-shaped replenishing port. Since this downward slope area has a width larger than a diameter of the coin, the coin dropped comes in face contact with the downward slope on its lower face, and slides down on the slope as it is. A part of the lower face of the coin sliding down on the downward slope then slides down on the guide rail at a predetermined speed. The guide rail is positioned, against the downward slope, on a downstream side of inclination of the overflow chute disposed below the guide rail. Thereby, the center of gravity of the coin sliding down on the guide rail is positioned on an upstream side of the overflow chute (away from the overflow chute) beyond the guide rail, so that the coin is guided and slides down by the guide rail while rolling (or rotating) with a contact point with the guide rail as a supporting point. In other words, the coin sliding down on the guide rail slides down while changing its posture gradually from a state parallel to the downward slope to a state perpendicular thereto. When coins have not fully accumulated in the coin storing portion in piles, a coin drops in the coin storing portion to be stored without dropping onto the overflow chute. When an amount of coins accumulated in the coin storing portion reaches a predetermined amount or more, a coin dropping while being guided by the guide rail is blocked by the coins accumulated so that the coin cannot reach the coin storing portion. Therefore, the coin blocked drops onto the overflow chute positioned below the guide rail due to gravity, and the coin slides down on the overflow chute as overflow. Therefore, the coin drops onto the overflow chute without being stored in a coin storing portion, so that there is an advantage that an amount of coins accumulated in the coin storing portion exceeds a predetermined amount from any accidental trouble. Further, since the present invention utilizes an ingenious layout of the downward slope, the guide rail, and the overflow chute and gravity to distribute coins, the present invention can cause the coins to overflow without using a full sensor or a distributing apparatus, so that there is an advantage that the present invention can be configured inexpensively.

In the present invention, it is preferable that the guide rail is set at a position (such that it extends laterally in the guide chute to a guide rail edge) of about one third of the diameter of the coin for a coin dropped from the replenishing port for coins. Due to this configuration, after the coin dropped from the replenishing port comes in face contact with the downward slope area on its lower face, a part of a lower face thereof is guided by the guide rail. In other words, the coin slides down on the downward slope, and then the coin slides down while a portion of about one third of the diameter of the coin is being guided by the guide rail. In this process, since the center of gravity of the coin is positioned at a position which is not guided by the guide rail, the coin slides down while being inclined to the side of gravity, in other words, the upstream side of the overflow chute. When a guided position of the coin guided by the guide rail is larger than about one third of the diameter of the coin, the coin requires time to incline at a predetermined angle. Therefore, the guide rail must be lengthened, which is not suitable for downsizing of the coin storing portion. When the guided position of the coin guided by the guide rail is smaller than about one third of the diameter of the coin, the coin is caused to take an approximately-vertical posture at short times, and drops onto the overflow chute from the guide rail before reaching the coin storing portion, so that a distributing function cannot be fulfilled. When such a configuration is made that the coin slides down while about one third of the diameter of the coin is put on the guide rail, a coin drops out of the guide rail into the coin storing portion at a position where the coin passes through the overflow chute having a width approximately corresponding to a diameter of the coin. Therefore, a minimum size of the overflow chute apparatus can be configured, so that there is an advantage that the coin storing portion can be downsized.

In the present invention, it is preferable that the lower end of the guide rail is disposed away from the upper face of the overflow chute by about two thirds of the diameter of the coin. According to this configuration, coins sliding down while being guided by the guide rail drop onto a predetermined position ahead of a distal end of the guide rail due to an inertial force of the sliding, and accumulate coins. When the coins are accumulated, a coin sliding off the lower end of the guide rail collides against the coins accumulated just after or before reaching the lower end and drops onto the overflow chute. Therefore, coins can be accumulated in the coin storing portion, and when an accumulating amount reaches a predetermined amount or more, coins can be caused to overflow directly into the overflow chute, so that there is an advantage that accidental coin jams occur less frequently.

The term "slot-shaped replenishing port" means that, when there is a plurality of replenishing ports, the slot-shaped replenishing port corresponds to one of the plurality of replenishing ports. The expression "when an amount of the coins in the coin storing portion reaches a predetermined amount" means that the amount of the coins approximately reaches the predetermined amount, and strictness to an exact amount is not an issue. Further, the expression "the downward overflow chute intersects at a predetermined angle to the guide rail" means that the downward overflow chute appears to intersect with the guide rail in a plan view, so they do not intersect with each other in fact. Furthermore, the expression "a coin dropped from the replenishing port comes in face contact with the downward slope" includes a state of the coin coming in face contact therewith substantially. For example, when the guide rail is configured such that a thin plate is disposed on the downward slope, the coin inclines to the downward slope and does not come in face contact therewith when viewed microscopically. Even this case is included in the range of "a coin comes in face contact with the downward slope".

The invention is a coin storing apparatus with an overflow chute apparatus for which is supplied with coins from a slot-shaped replenishing port to a coin storing portion and stores the coins in piles in the coin storing portion, and causes the coins to overflow via a downward overflow chute having a width equal to or larger than a diameter of a coin when an amount of the coins in the coin storing portion reaches a predetermined amount. A downward slope wider than the diameter of the coin is disposed below the replenishing port, a guide rail having a predetermined length which is continuous with the downward slope and extends to elongate a part of the downward slope is provided on a downstream side of the overflow chute beyond a center of gravity of a coin sliding down on the downward slope, the guide rail is set at a position of about one third of the diameter of the coin for a coin dropped from the replenishing port for coins, the downward overflow chute is disposed below the guide rail such that the downward overflow chute intersects at a predetermined angle to the guide rail, and a lower end of the guide rail is disposed away from an upper face of the overflow chute by about two thirds of the diameter of the coin, wherein, after a coin dropped from the replenishing port comes in face contact with the downward slope, a lower face of the coin on a downstream side of the overflow chute beyond the center of gravity of the coin is guided by the guide rail to reach the coin storing portion, and coins accumulated in the coin storing portion can be moved to the overflow chute.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
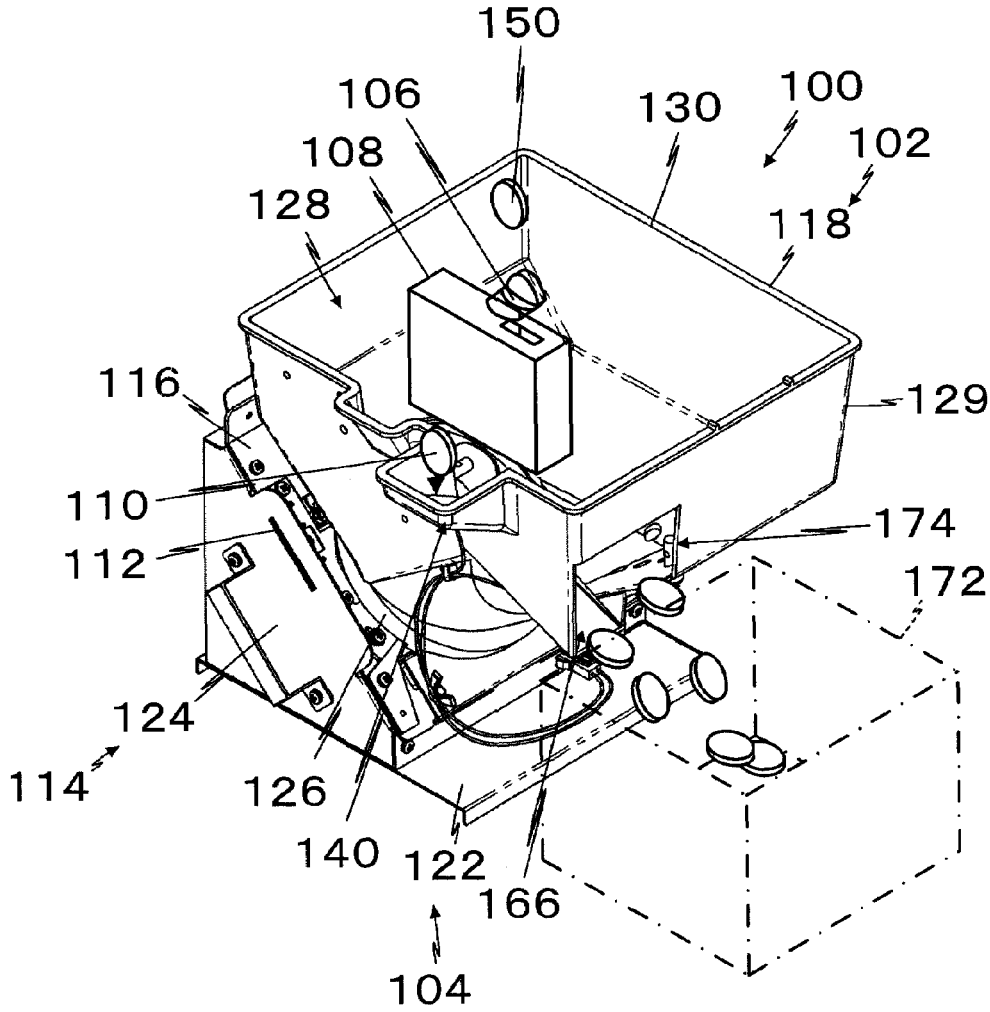
FIG. 1 is a schematic perspective view of an overflow chute apparatus for a coin storing apparatus according to an embodiment.

Referring to the drawings in particular, the present invention comprises a coin storing apparatus 102 of a coin hopper 100 with an overflow chute apparatus 104. This is part of a coin dispensing apparatus incorporated in a gaming machine such as a pachinko-slot machine.

The coin hopper 100 has a function of storing true coins 110 in bulk which are deposited to a slot 106 of a casing of the pachinko-slot machine as a bet and selected by a coin selector 108. The true coins 110 are dispensed one by one from a dispensing port (throwing-out port) 112. The coin hopper 100 includes at least a frame 114, a hopper base 116, a storing bowl 118, serving as a coin storing apparatus 102, and a rotary disk 120.

The frame 114 has a function of supporting the hopper base 116 and the storing bowl 118, and is made of sheet metal. The frame 114 includes a base 122, and a supporting member 124 having a triangular pole shape supported by the base 122. The supporting member 124 is fixed on the base 122 slidable to the casing of the pachinko-slot machine. A control board and an electric motor, for driving the rotary disk 120, are disposed in a hollow portion of the supporting member 124. A head portion of the supporting member 124 is formed to be inclined.

The hopper base 116 has a function of holding the storing bowl 118 and the rotary disk 120 at predetermined positions, and a function of guiding the coin 110 moved by the rotary disk 120. The hopper base 116 is formed in a rectangular plate shape, and fixed on the inclined head portion of the supporting member 124. In other words, the hopper base 116 is inclined at a predetermined angle.

The storing bowl 118 has a function of accumulating the coins 110 in bulk. A lower end portion 126 of the storing bowl 118 is formed in a cylinder having a constant diameter, and extends in a direction perpendicular to the hopper base 116. The lower end portion 126 extends obliquely upward, an upper end portion 129 thereof is formed of a quadrangle, and an upper end of the upper end portion 129 is a coin throwing-in opening 130. An inner portion of the storing bowl 118 is a coin storing portion 128. The quadrangular upper end portion 129 and the lower end portion 126 of the storing bowl 118 are connected to each other by inclined walls 132, 134, and 136, and the coins 112 on the inclined walls 132, 134, and 136 slide down naturally due to gravity, and drop onto the rotary disk 120 below the storing bowl 118. A part of the quadrangular upper end portion 129 of the storing bowl 118 is formed of a projecting rectangle to provide a coin replenishing portion 140. The coin replenishing portion 140 is positioned just below a replenishing port 141 (shown by dashed line in FIG. 2) which is a dropping port for the true coins 110 of the coin selector 108. The coin replenishing portion 140 is formed in a gutter with a downward slope area 142 inclined downward toward the inclined wall 134, and a first wall 144, a second wall 146, and a third wall 148 which surround three sides of the downward slope 142. The downward slope area 142 has an inclination for the coin 110 to drop naturally due to gravity, and communicates with the coin storing portion 128.

The rotary disk 120 has a function of separating the coins 112 stored in bulk in the coin storing portion 128 of the storing bowl 118 one by one and sending them out from the throwing-out port 112. The rotary disk 120 is disposed in a cylindrical portion of the lower end portion 126 of the storing bowl 118. Rotation of the rotary disk 120 is driven by the electric motor (not shown) at a predetermined speed via reduction gears. The rotary disk 120 includes a pan-like sheet-plate rotary member 152 having a cylindrical flange 150 and a sprocket-like sting member 156 formed with recessed portions 154 on its peripheral edge at even intervals. Circular through holes 158 are formed on the bottom of the pan of the rotary member 152 at even intervals. The sting member 156 is fixed on the bottom of the pan of the rotary member 152 such that the recessed portions 154 and the through holes 158 overlap with each other. A pushing and moving portion (not shown) is formed on a lower face of a rib 160 between the through holes 158 of the rotary member 152. When the rotary disk 120 rotates in a clockwise direction in FIG. 2, the coins 110 in the coin storing portion 128 are stirred by the sting member 156 slightly projecting to change postures of the coins 110, and dropped through the through holes 158. Lower faces of the coins 110 dropped come in contact with the hopper base 116 to be supported, and peripheral edges thereof are pushed by the pushing and moving portion. Thereby, the coins 110 slide on the hopper base 116 while the peripheral edges of the coins 110 are guided by an inner wall of the lower end portion 126, and the coins 110 are rotated according to rotation of the rotary disk 120. The coins 110 are guided in a peripheral direction of the rotary disk 120 at a predetermined position by a restricting member 162 on their way to be rotated according to rotation of the rotary disk 120 and thrown out from the throwing-out port 112 by a throwing-out apparatus (not shown).

An embodiment of an overflow chute apparatus 160 according to the present invention is shown in the Figures and is described as follows. The overflow chute apparatus 160 has a function of causing the coins 110 to overflow to the outside of the storing bowl 118 from the coin storing portion 128 when an amount of the coins 110 in the storing bowl 118 reaches a predetermined amount or more. The overflow chute apparatus 160 includes at least the downward slope 142, an overflow chute 162, and a guide rail 164.

Figure 2:
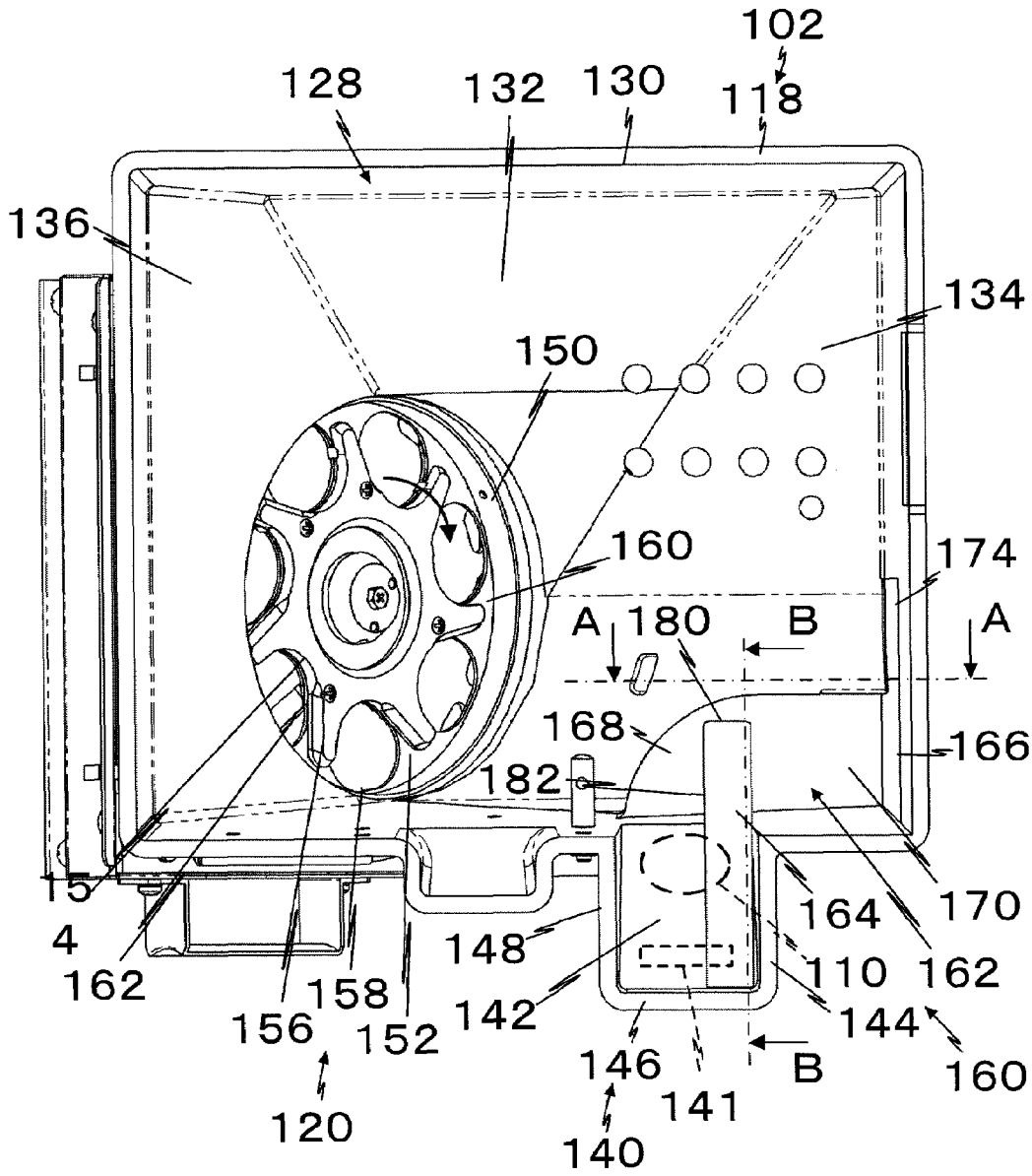
FIG. 2 is a plan view of the overflow chute apparatus for the coin storing apparatus according to the embodiment.
Figure 3:
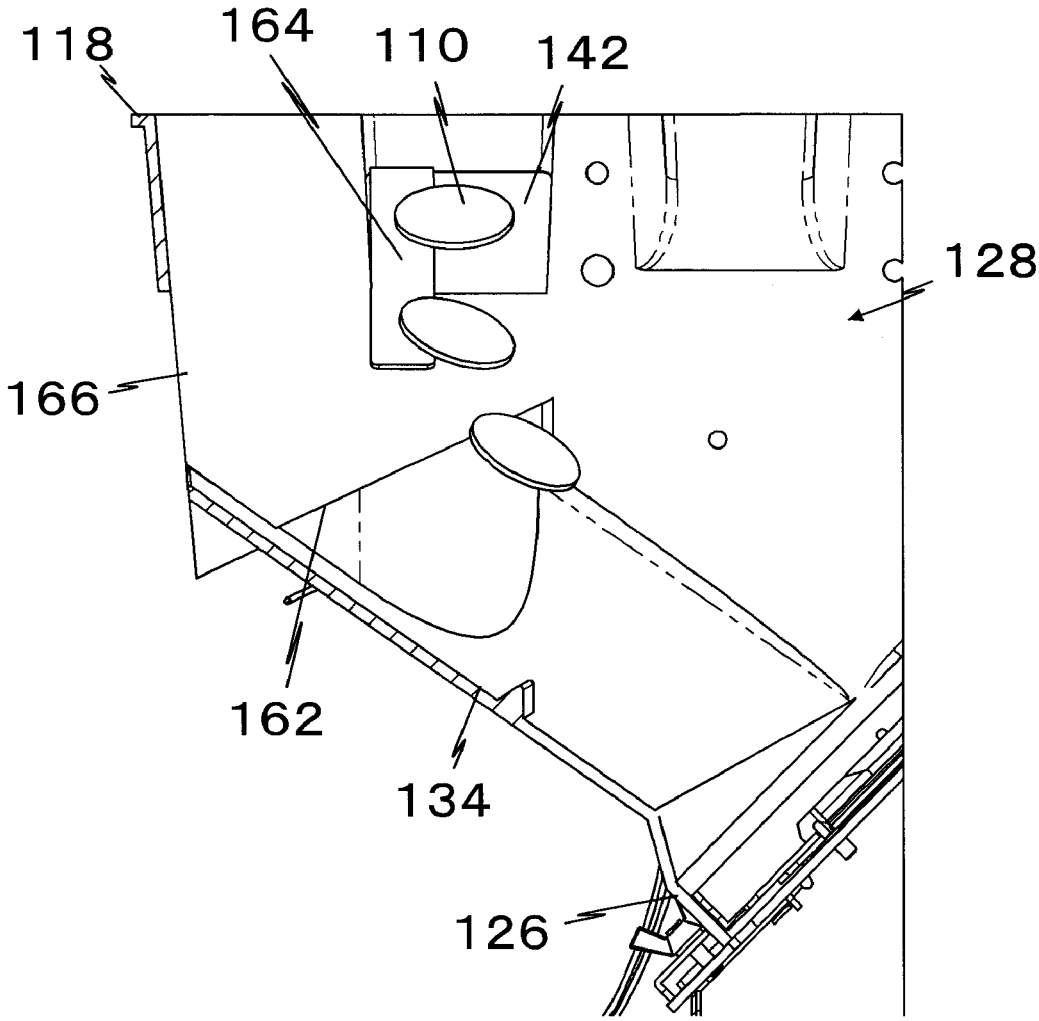
FIG. 3 is a sectional view of the overflow chute apparatus for the coin storing apparatus taken along line A-A in FIG. 2.

The overflow chute 162 has a function of causing the coins 110 to slide down naturally due to gravity and overflow through an overflow port 166 when an amount of the coins 110 in the coin storing portion 128 reaches a predetermined amount or more. The coins 110 slide down from the accumulated portion naturally due to gravity to get on the overflow chute 162. In this embodiment, the overflow chute 162 is formed of a slide inclined downward at a predetermined angle, and fixed on a side wall of the storing bowl 118 on the side of the coin replenishing portion 140. In a plan view as shown in FIG. 2, the overflow chute 162 extends linearly such that the overflow chute 162 intersects with the guide rail 164. The overflow chute 162 has a width slightly wider than the diameter of the coin 110, an upper end portion 168 of the overflow chute 162 is disposed below the downward slope 142, and a lower end portion 170 thereof is connected to the overflow port 166 opening on the side wall of the storing bowl 118 on the side. In other words, the overflow chute 162 is positioned inside the coin storing portion 128, and extends downward in a direction approximately perpendicular to an extending direction of the downward slope 142, ahead of and down below the downward slope 142. The overflow chute 162 is a slope inclined downward from the upper end portion 168 to the lower end portion 170, and inclined at about 30 degrees to a horizontal line. As for this downward angle, when the angle is small, a sliding-down speed of the coin 110 is not stabilized, which may cause a coin jam, while when the angle is large, a position where the coins 110 are accumulated becomes the lower portion of the coin storing portion 128, a stored amount per unit volume is reduced, so that an angle of about 30 degrees is preferable. The overflow chute 162 has a flat surface in this embodiment, but a ridged portion extending in a sliding direction of the coins 110 can be formed in order to reduce frictional resistance generated when the coins 110 slide down.

It is preferable to dispose a safe 172 below the overflow port 166 to store the coins 110 caused to overflow. It is preferable to provide a subsidiary overflow port 174 which is continuous with the overflow port 166 and communicates with the coin storing portion 128. This is done because, by causing the coin 110 accumulated in the coin storing portion 128 to overflow from the subsidiary overflow port 174 as well as the overflow port 166, the coins 100 are formed in a piling shape so that the coins 110 guided by the guide rail 164 collide against the coins 110 accumulated to drop onto the overflow chute 162 reliably.

The guide rail 164 has a function of guiding a lower face of an end portion of the coin 110 on a downstream side (nearer the overflow chute 162), following the downward slope area 142. The guide rail 164 is a metallic thin plate having a long and thin rectangular shape in this embodiment, one end portion of the guide rail 164 is fixed on the downward slope 142 on the downstream side thereof, near the overflow chute 162. The other end portion thereof projects inside the coin storing portion 128 above the overflow chute 162 from the downward slope 142. Inclination angles of the downward slope 142 and the guide rail 164 are preferably about 30 degrees similarly to the overflow chute 162. It is preferable that the guide rail 164 is disposed to overlap with about one third of the diameter of the coin 110 dropped from the replenishing port 141 for the coins 110, in this embodiment, a specie port of the coin selector 108 on the downstream side of the overflow chute 162. In other words, the guide rail 164 extends downward in the same direction as the downward slope 142 extends, and is disposed such that the coins 110 slide down while about one third of the coin 110, shown by dashed line in FIG. 2, slides down on the downward slope 142 on the side of the overflow port 166 that is in contact with the guide rail 164. A distal end 180 of the guide rail 164 is positioned above the overflow chute 162, and disposed away from the overflow chute 162 by a distance approximately corresponding to the diameter of the coin 110. This is for making it possible for the coins 110 accumulated in piles in the coin storing portion 128 to slide down due to gravity and reach the overflow chute 162 through between the distal end 180 and the coins 110 accumulated.

The guide rail 164 can be a plate form as shown and may also be a bar. In other words, in FIG. 2, a bar can be disposed at a position corresponding to an end edge 182 of the guide rail 164 on the upstream side of the overflow chute 162. The guide rail can be molded integrally with the downward slope 142. In other words, a part of the downward slope 142 on the downstream side of the overflow chute 162 is protruded to a predetermined extent inside the coin storing portion 128.

Figure 4:
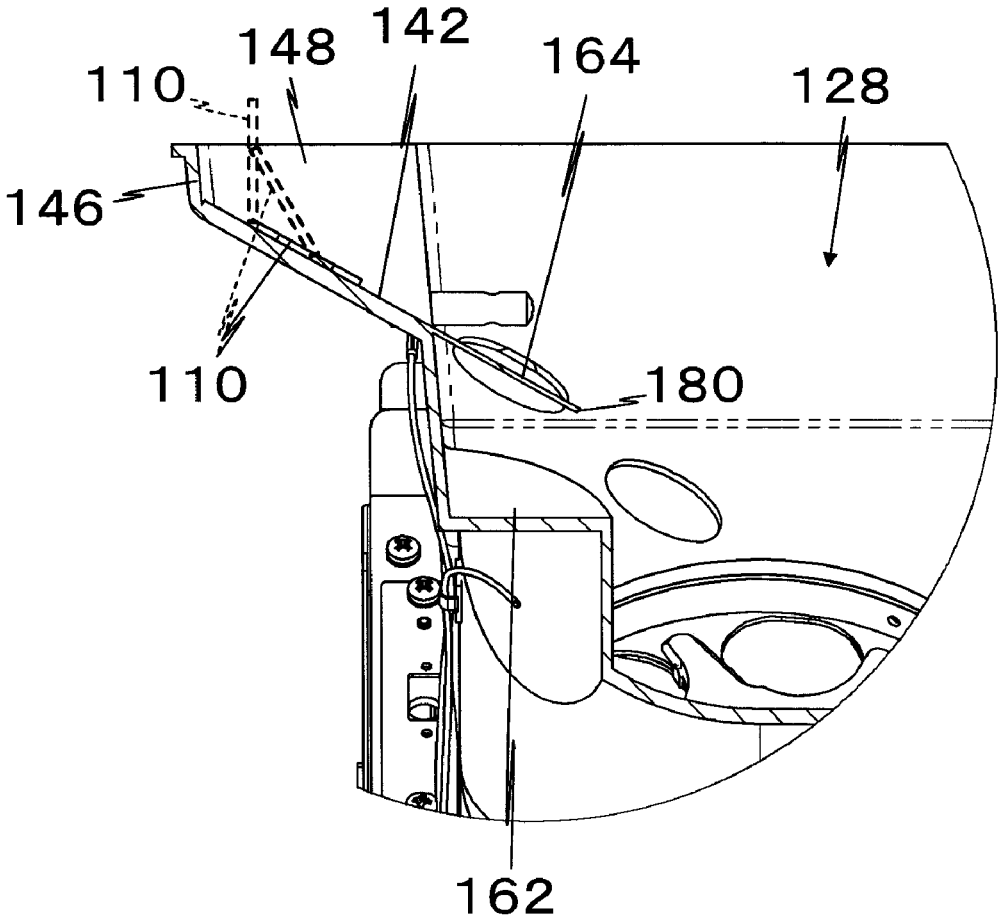
FIG. 4 is a sectional view of the overflow chute apparatus for the coin storing apparatus taken along line B-B in FIG. 2.
Figure 5A:
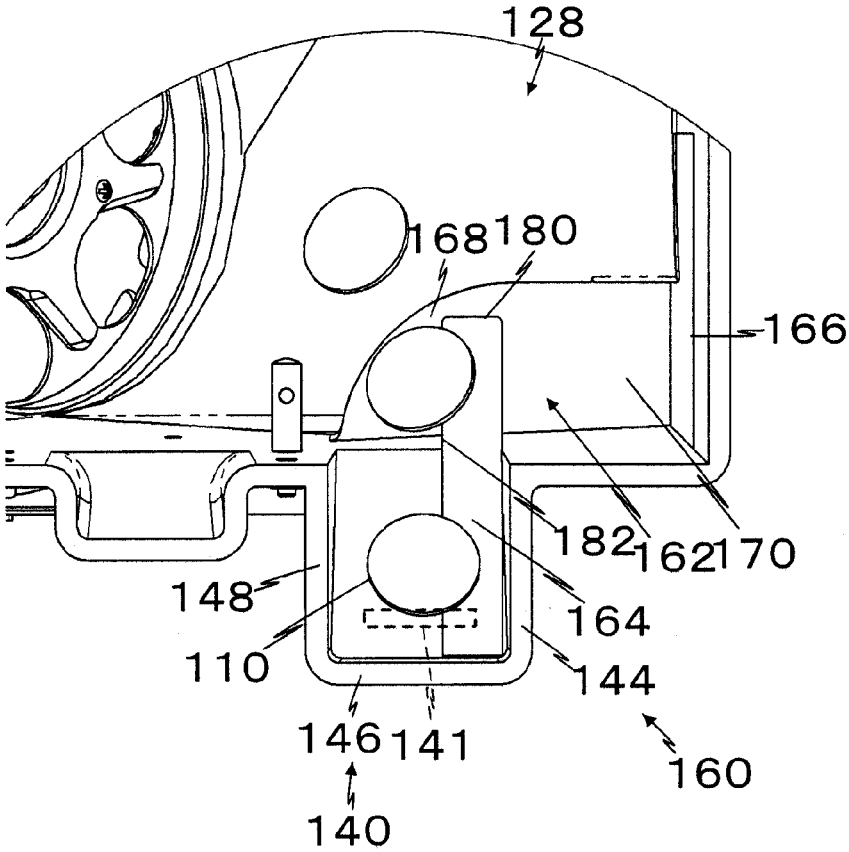
FIG. 5A is a top operational explanatory view in a case in which coins in a coin storing portion according to the embodiment are not accumulated in piles.
Figure 5B:
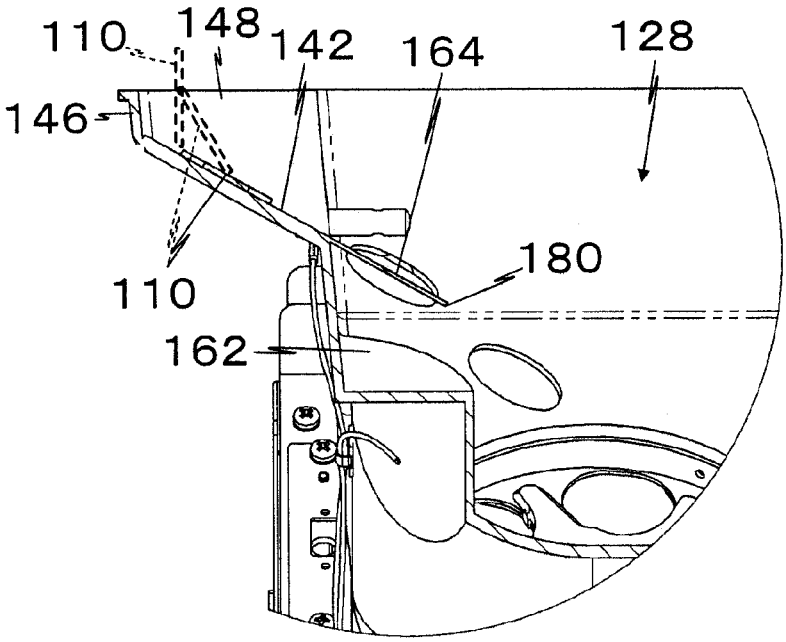
FIG. 5B is a side sectional operational explanatory view in a case in which coins in a coin storing portion according to the embodiment are not accumulated in piles.

Next, the operation of this embodiment is explained with reference to FIGS. 5A and 5B and FIGS. 6A and 6B, as well as to the other drawings. The coin 110 is dropped approximately vertically from the replenishing port 141, which is the specie port of the coin selector 108, and collides against an upper portion of the downward slope 142. At this time, since the coin 110 is approximately perpendicular to a horizontal line, a lower end of the coin 110 collides against the downward slope 142 obtusely as shown in FIG. 4. Thereby, the lower end of the coin 110 receives a component force directed to the downstream side of the downward slope 142, and turns in the same direction, as a result, the lower face of the coin 110 comes in face contact with the downward slope 142. The coin 110 then slides down while being in face contact with upper portions of the downward slope 142 and the guide rail 164. At this time, about one third of the end portion of the coin 110 on the downstream side, the overflow chute 162 side, slides down on the guide rail 164. This is because the guide rail 164 is disposed such that a part of the guide rail 164 overlaps with about one third of the diameter of the coin 110 dropped. When the coin 110 sliding down goes out of the downward slope 142, the center of gravity of the coin 110 is positioned on the upstream side relative to the overflow chute 162, beyond the guide rail 164, because about one third of the coin 110 faces (has face contact with) the guide rail 164. For this reason, as shown in FIGS. 5A and 5B, a turning force is generated on the coin 110 due to gravity, and the coin 110 slides down while rolling with the end edge 182 of the guide rail 164 on the upstream side of the overflow chute 162 as a supporting point. At this time, since the guide rail 164 is inclined downward so that the coin 110 receives an inertial force of the sliding, the coin 110 slides down while a part of the lower face of the coin 110, which corresponds to about one third of the diameter of the coin 110 on the downstream side of the overflow chute 162, is in contact with the end edge 182 of the guide rail 164 on the upstream side of the overflow chute 162.

Figure 6A:
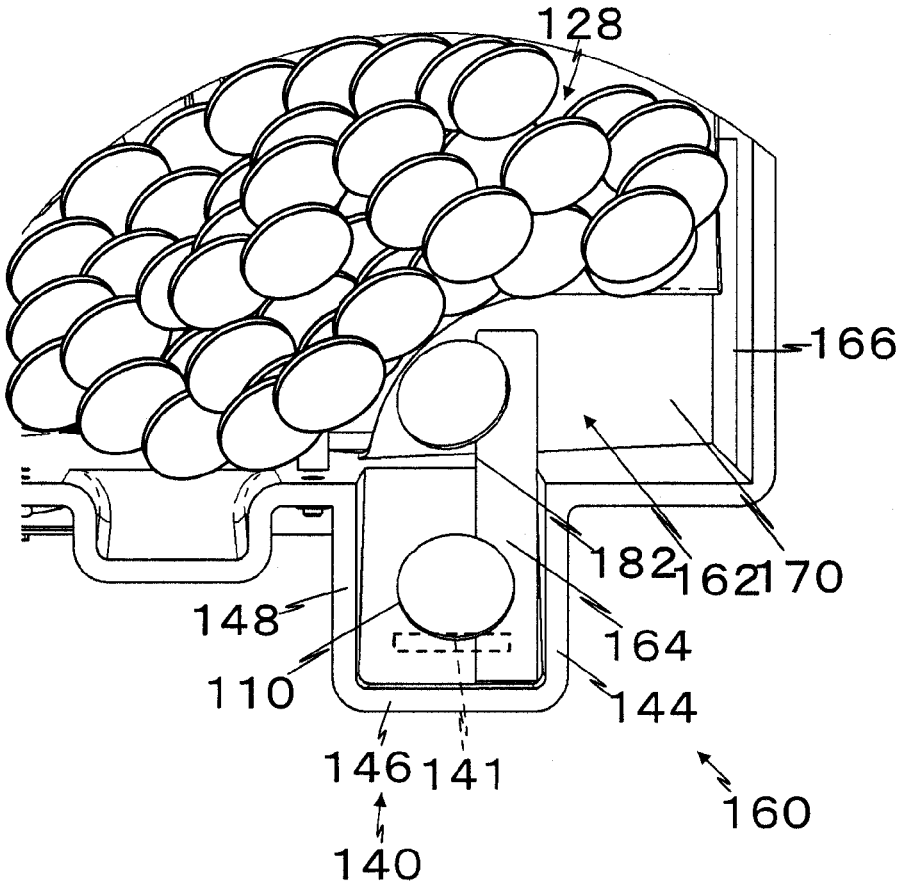
FIG. 6A is a top operational explanatory view in a case in which coins in the coin storing portion according to the embodiment are accumulated in piles.
Figure 6B:
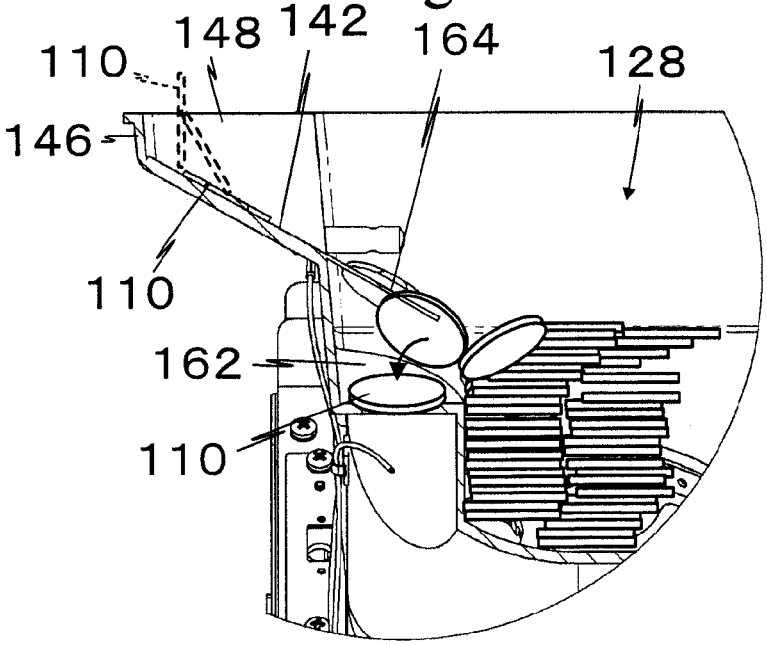
FIG. 6B is a side sectional operational explanatory view in a case in which coins in the coin storing portion according to the embodiment are accumulated in piles.

As shown in FIG. 5B, when the coins 110 are not accumulated in the coin storing portion 128, the coin 110 sliding down while guided by the guide rail 164 is dropped into the coin storing portion 128 beyond the overflow chute 162 to be accumulated. As shown in FIG. 6B, when an amount of the coins 110 in the coin storing portion 128 reaches a predetermined amount or more, in other words, when the coins 110 are accumulated in piles on the side of the overflow chute 162, and a skirt portion of the pile reaches the overflow chute 162, the coin 110 collides against the coins 110 accumulated when guided by the guide rail 164 or just after going out of the guide rail 164, and drops approximately directly below. Therefore, the coin 110 drops onto the overflow chute 162, slides down on the overflow chute 162, and drops into the safe 172 from the overflow port 166 to be stored.

When an amount of the coins 110 reaches a predetermined amount or more, the coins 110 slide down on a surface of the pile due to gravity to reach the overflow chute 162, and slide down on the overflow chute 162 to drop into the safe 172 from the overflow port 166 to be stored. Since the distal end 180 of the guide rail 164 and the overflow chute 162 are disposed away from each other by a distance approximately corresponding to the diameter of the coin, a space is always formed between the distal end 180 and the coins 110 accumulated. Therefore, the coin 110 sliding down on the surface of the pile of the accumulated coins 110 can reach the overflow chute 162 through the space, as described above. Since the space is always formed, no coin jam is caused by the guide rail 164.

While specific embodiments of the invention have been shown and described in detail to illustrate the application of the principles of the invention, it will be understood that the invention may be embodied otherwise without departing from such principles.

What is claimed is:

1. A coin storing apparatus with overflow chute, the apparatus comprising:

a coin storing portion;

a slot-shaped replenishing port for supplying said coin storing portion with coins for storing the coins in piles in the coin storing portion;

a downward overflow chute for directing an overflow of the coins, when an amount of the coins in the coin storing portion reaches a predetermined amount, via said downward overflow chute, said overflow chute having a width equal to or larger than a coin diameter and with a downward slope area wider than a coin diameter disposed below the replenishing port;

a guide rail having a predetermined length which is continuous with said downward slope area and extends to elongate a part of said downward slope area, said guide rail being provided on a downstream side of said overflow chute beyond a center of gravity of a coin sliding down on said downward slope area, said downward overflow chute being disposed below said guide rail such that said downward overflow chute intersects said guide rail at a predetermined angle, wherein after a coin dropped from the replenishing port comes in face contact with the downward slope area, a lower face of the coin on a downstream side of the overflow chute is guided by the guide rail to reach the coin storing portion, and coins accumulated in the coin storing portion can be moved to the overflow chute.

2. A coin storing apparatus with overflow chute according to claim 1, wherein the guide rail is set at a position for engagement of about one third of the diameter of the coin for a coin dropped from the replenishing port for coins.

3. A coin storing apparatus with overflow chute according to claim 1, wherein a lower end of said guide rail is disposed away from an upper face of said overflow chute by about two thirds of the diameter of the coin.

4. A coin storing apparatus with overflow chute, the apparatus comprising:

a coin storing portion;

a slot-shaped replenishing port for supplying said coin storing portion with coins for storing the coins;

a downward overflow chute for directing an overflow of the coins, when an amount of the coins in the coin storing portion reaches a predetermined amount, via said downward overflow chute, said overflow chute having a width equal to or larger than a coin diameter and with a downward slope area wider than a coin diameter, said downward overflow chute being disposed below the replenishing port;

a guide element disposed along a length of said downward slope area and extending outwardly therefrom above a downstream portion of said downward overflow chute, said guide element being disposed along a downstream portion side of said downward slope area to engage a portion of a surface of a coin sliding down on said downward slope area to direct the coin sliding down to said coin storing portion unless coins in said coin storing portion block the coin sliding down from entering said coin storing portion and to direct the coin sliding down to said downstream portion of said overflow chute if coins in said coin storing portion block the coin sliding down from entering said coin storing portion.

5. A coin storing apparatus according to claim 4, wherein said guide element engages a portion of the coin sliding down that does not include a center of gravity of the coin sliding down, such that coins are directed toward said coin storing portion.

6. An coin storing apparatus according to claim 5, wherein the guide element is set at a position for engagement of about one third of the diameter of the coin for a coin dropped from the replenishing port for coins.

7. A coin storing apparatus according to claim 6, wherein a lower end of said guide element is disposed away from an upper face of said overflow chute by about two thirds of the diameter of the coin.

* * * * *